United States Patent [19]

Kitsukawa

[11] Patent Number: 4,460,104

[45] Date of Patent: Jul. 17, 1984

[54] O-RING FOR SEALING BETWEEN FUEL CAP AND FILLER NECK OF AUTOMOBILES

[75] Inventor: Akira Kitsukawa, Ayase, Japan

[73] Assignee: Nihon Radiator Co., Ltd., Tokyo, Japan

[21] Appl. No.: 508,252

[22] Filed: Jun. 27, 1983

[30] Foreign Application Priority Data

Nov. 27, 1982 [JP] Japan ..... 57-179735[U]

[51] Int. Cl.[3] ..... B65D 53/00

[52] U.S. Cl. ..... 220/304; 220/DIG. 33; 296/1 C

[58] Field of Search ..... 220/304, 295, 288, DIG. 33; 277/177, 207 A, 206 R; 251/DIG. 1; 296/1 C

[56] References Cited

U.S. PATENT DOCUMENTS 4,065,026 12/1977 Williams et al. ..... 220/304
4,072,245 2/1978 Sloan, Jr. ..... 220/295
4,102,472 7/1978 Sloan, Jr. ..... 220/295
4,142,756 3/1979 Henning et al. ..... 220/304
4,228,915 10/1980 Hooper et al. ..... 220/304

*Primary Examiner*—George T. Hall
*Attorney, Agent, or Firm*—Kalish & Gilster

[57] ABSTRACT

An O-ring for providing hermetic sealing between a fuel tank filler neck and its cap has a single main body with an integrally formed annular lip projecting outwardly from the main body; the lip has an inclined lower surface for contacting a corresponding inclined upper surface of said filler neck, such lower surface defining an angle of inclination $\theta_1$ with respect to the horizontal principal extent of the O-ring body, the filler neck upper surface defining an angle of inclination $\theta_3$ with respect to horizontal, $\theta_1$ being substantially less than $\theta_3$, the lip being deformable upon tightening of said cap to bring the lip lower surface into hermetically sealing contact with the filler neck upper surface.

10 Claims, 12 Drawing Figures

PRIOR ART

PRIOR ART

RETURN LEAKAGE ANGLE DATA
TORQUE 0.15 kg/m2
: PRIOR ART
: THIS INVENTION
2.0 kg/cm2
0.005 kg/cm2
THE TEST WAS CONDUCTED AT A WITHSTAND PRESSURE OF 1.0 kg/cm2
INITIAL PERFORMANCE
GASOLINE IMMERSION
O3 COMPOSITE
REMOVAL
INITIAL PERFORMANCE
GASOLINE IMMERSION
O3 COMPOSITE
REMOVAL
ANGLE (DEGREE)
100
50
0

O-RING FOR SEALING BETWEEN FUEL CAP AND FILLER NECK OF AUTOMOBILES

BACKGROUND AND SUMMER OF THE INVENTION

This invention relates to O-rings and, more particularly, to an O-ring specifically designed for providing improved hermetic sealing by being disposed between an automotive fuel cap and the fuel filler neck.

Heretofore, O-rings have been utilized for providing sealing between a fuel tank cap and the filler neck to which the cap is secured. Thus, referring to FIG. 1, a so-called O-ring 3 is disposed between a fuel tank filler neck 1 and a cap 2, for example, in order to keep them sealed hermetically. The conventional O-ring 3 of this type has a round cross-section as shown in FIG. 2.

However, a conventional O-ring having a round cross-section has a small deflection and a small pressure-receiving area and does not come into close contact with the filler neck 1 and the cap 2. Hence, it fails to provide a sufficiently hermetic seal. Accordingly, various O-rings have been proposed in the past such as an O-ring 3*a* whose main body 4*a* has a round cross-section but is equipped with a V-shaped groove 5*a* as shown in FIG. 3, and an O-ring 3*b* equipped with a groove 5*b* which is approximately V-shaped in the main ring body 4*b* which has a squared round cross-section as shown in FIG. 4. (Refer, for example, to Japanese Patent Publication No. 40028/1982.) These constructions increase the deflection and the pressure-receiving area of the O-rings 3*a*, 3*b* and thus improve their hermetic sealing, but their deflection and pressure-receiving area are not yet sufficient. When the internal pressure inside the fuel tank increases, therefore, the fuel is likely to leak from between the cap 2 and the filler neck 1. In particular, when a large impact is applied to the cap 2 such as in a collision of the car, a gap coved occur between the O-ring 3*a* or 3*b* and the cap 2 or the filler neck 1.

It is an object of the present invention to provide an O-ring for a cop which has an increase pressure-receiving area and deflection, maintains a sufficient hermetic seal between the cap and the filler neck, and prevents the leakage of fluid such as fuel.

It is also an object of the present invention to provide such an O-ring which is particularly intended for use in providing hermetic sealing between the fuel cap and the filler neck of automobiles, and which ensures that fuel will not leak even in the event of a collision which may apply a large impact force to the cap, or which may cause internal pressure of the fuel.

It is a further object of the invention to provide such an O-ring which provides a hermetic seal without any special effort or procedure on the part of the user; which is inexpensive, simple, and economical to manufacture; and which is reliable and long lasting in use.

To accomplish the objects described above, in an O-ring sealing the gap between a filler neck having an inclined upper surface expanding outward in a flare and a cap fitted onto the filler neck, the present invention employs a construction in which an annular lip is formed integrally with the main body of the ring so as to project outward, the surface of the lip which comes into contact with the inclined upper surface of the filler neck is inclined downward towards the center of the ring, the angle of inclination $\theta_1$ between the contact surface of the main ring body 1 and the horizontal is made smaller than the angle of inclination $\theta_3$ between the inclined upper surface of the filler neck and the horizontal, and the angle $\theta_2$ of the groove between the upper surface of the lip and the main ring body is approximately 90°.

DESCRIPTION OF THE PREFERRED EMBODIMENT

Figure 5:
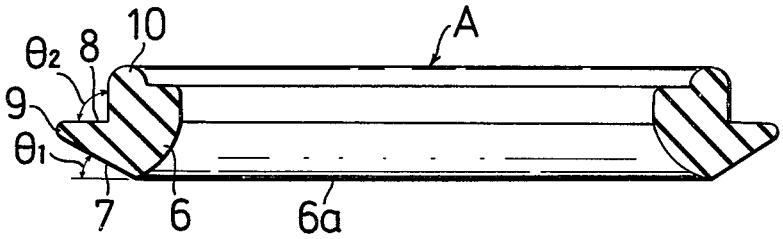
FIG. 5 is a sectional view of the O-ring for a cap in accordance with one embodiment of the present invention.

Referring by reference characters to the accompanying drawings, FIG. 5 shows the O-ring for a cap in accordance with a first embodiment of the present invention.

In the O-ring A for a cap in accordance with the present invention, as formed conventionally of known resilient material, an outwardly projecting annular lip 9 is formed integrally with a main ring body 6, and a surface 7 of this lip 9 which comes into contact with an inclined upper surface 12 of a filler neck 11 is inclined downward towards the center of the ring. The angle of inclination $\theta_1$ between the contact surface 7 and a horizontal surface 6*a* or horizontal principal extents of the main ring body 6 is made to be smaller than the angle of inclination $\theta_3$ between the inclined upper surface 12 of the filler neck 11 and a horizontal surface 11*a* thereof (approximately $\theta_1=30°$ and $\theta_3=45°$ in this embodiment). The angle $\theta_2$ of the groove between an upper surface 8 of the lip 9 and the main ring body 6 is made approximately 90°. A protuberance 10 having an annular, arcuate-sectioned shape is formed around the upper part of the main ring body 6.

Figure 6:
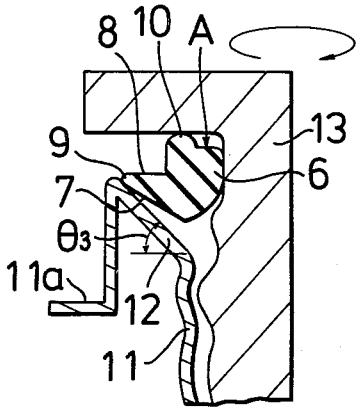
FIG. 6 is a sectional view of the principal parts showing the O-ring for a cap of FIG. 5 disposed between the cap and the filler neck and the cap has been fastened gently, i.e., before tightening.
Figure 7:
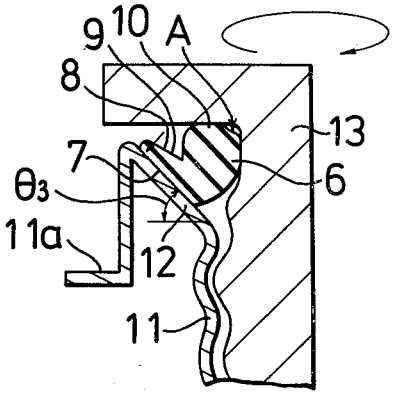
FIG. 7 is a sectional view of the principal parts showing the O-ring for a cap of FIG. 5 disposed between the cap and the filler neck, and the cap has been fastened firmly.
Figure 8:
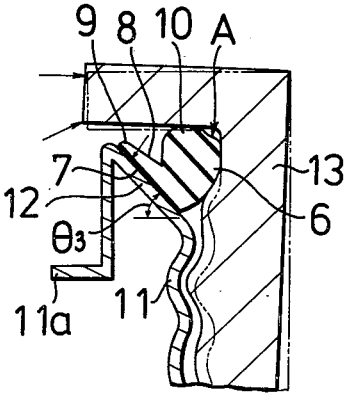
FIG. 8 is a sectional view of the principal parts showing the O-ring for a cap of FIG. 5 disposed between the cap and the filler neck, the cap has been fastened and an impact force has then been applied to the cap.

The O-ring A for a cap with the construction described above is interposed between the filler neck 11 (the inclined upper surface 12 thereof being shaped as an outward flare) of a fuel tank, for example, and a cap 13, as shown in FIG. 6. Next, as shown in FIG. 7, the cap 13 is screwed in tightly so that the lip 9 on the main ring body 6 is pressed into contact with the inclined upper surface 12 of the filler neck 11, sealing the cap hermetically.

In other words, when the O-ring A for the cap is interposed between the filler neck 11 of the fuel tank and the cap 13 and is fastened gently as shown in FIG. 6, only the end of the lip 9 comes into contact with the inclined upper surface 12 of the filler neck 11, providing a hermetic seal between the filler neck 11 and the cap 13 to some extent. When the cap 13 is fastened tightly as shown in FIG. 7, however, the end of the lip 9 is pushed up with the fastening and the contact area between the contact surface 7 of the lip and the inclined upper surface 12 of the filler neck 11 becomes greater, thereby increasing the hermetic seal between them further to a sufficient level. In other words, the angle of inclination $\theta_1$ of the contact surface 7 of the lip 9, that was originally 30°, increases to 45° as surface 7 of lip 9 is rolled into progressively closer and closer conformance with the inclined upper surface 12 as the cap 13 is fastened and so the pressure-receiving area between them thereby increases and provides a sufficient hermetic sealing effect, the pressure-receiving area of seal ultimately being approximately the entire contact surface 7 of lip 9, as seen in FIG. 7.

Since the angle of inclination $\theta_1$ of the contact surface 7 of the lip 9 and the groove angle $\theta_2$ of the upper surface 8 of the lip 9 are 30° and 90°, respectively, the thickness of the lip 9 is reduced and its flexibility increased so that the inclined upper surface 12 of the filler neck 11 is pressed strongly into contact with surface 7. Similarly, the arcuate sectioned shape of protuberance 10 is flattened to increase also the area of contact between protuberance 10 and the corresponding undersurface of the flange of filler cap 13. Hence the hermetic seal and the reliability between the cap 13 and the filler neck 11 are increased further and no fuel can leak from the tank even when the internal pressure of the fuel tank rises. In particular, when the car is in a collision and a large impact force is applied to the cap 13 in the direction of the arrow in FIG. 13, a sufficient hermetic seal can be secured between the O-ring A of the cap and the filler neck 11 due to the large pressure receiving area between the O-ring A and the filler neck 11. Needless to say, the wide main ring body 6 and the cap 13 come into contact and provide a sufficient hermetic seal between the O-ring A and the cap 13, and maintain a good hermetic seal between the cap 13 and the filler neck 11 of the fuel tank always, preventing leakage of the fuel.

Because the main ring body 6 is equipped with the protuberance 10 with an annular, arcuate section about its upper part, the flexibility of the main ring body 6 is increased as a whole and makes the hermetic seal between the O-ring A and the cap 13 more reliable, and hence that between the cap 13 and the filler neck 11 of the fuel tank.

Figure 9:
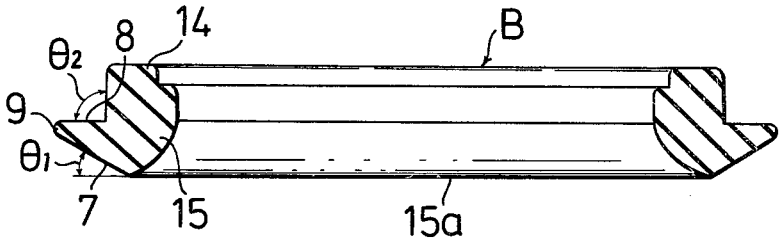
FIG. 9 is a sectional view of the O-ring for a cap in accordance with another embodiment of the present invention.

FIG. 9 shows the O-ring for a cap in accordance with another embodiment of the present invention. In this embodiment, a main ring body 15 is equipped with a protuberance 14 having an annular rectangular, i.e., square, section around its upper region which engages the overlying cap portion.

Since the protuberance 14 with an annular square section is disposed around the upper part of the main ring body 15 for increased area of contact with the filler cap 13 even before the cap 13 is tightened, the flexibility of the main ring body 15 itself being increased in this embodiment, and so that the hermetic seal between the O-ring and the cap 13 becomes reliable in the same way as in the first embodiment described above. This O-ring B of the cap of course has lip 9 with $\theta_1$ being the same and otherwise of the same configuration as the previous embodiment so that the pressure-receiving area between the cap and the filler neck of the fuel tank and the flexibility increases, thereby improving the hermetic seal between them and preventing the leakage of fuel.

Figure 10:
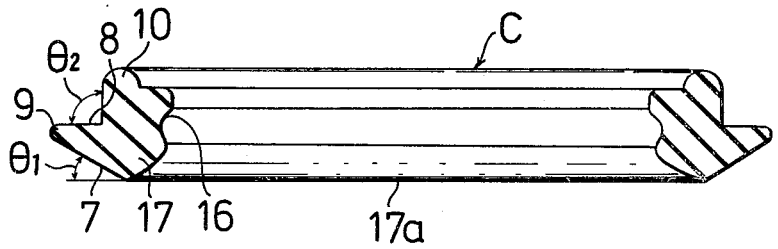
FIG. 10 is a sectional view of the O-ring for a cap in accordance with a third embodiment of the present invention.
Figure 11:
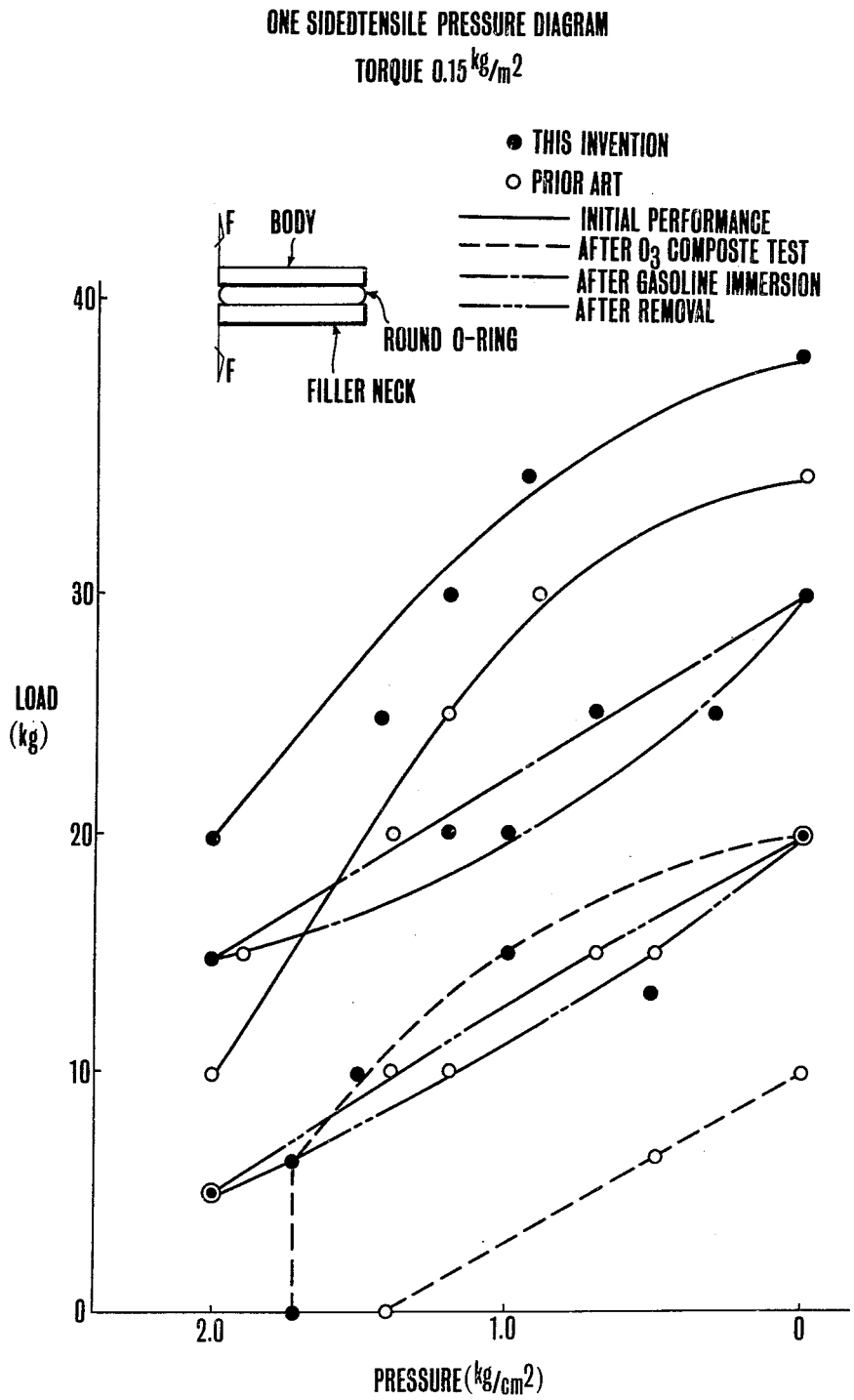
FIG. 11 is a diagram showing the results of one-sided, i.e., one direction, tensile pressure tests on the embodiments of the present invention.
Figure 12:
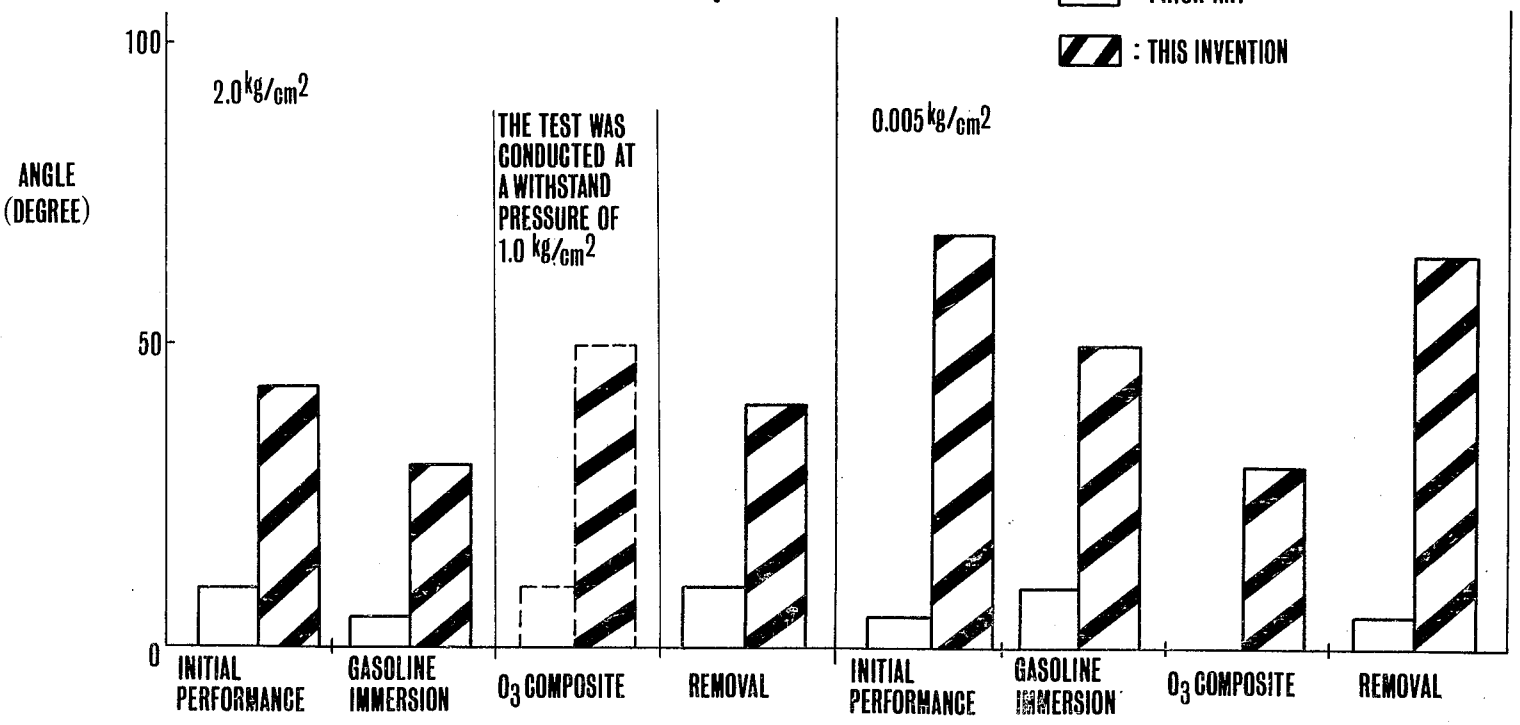
FIG. 12 is a diagram showing return leakage angle data after tests on the embodiments of the present invention.

FIG. 10 shows still another embodiment of the present invention, in which a main ring body 17 has a cross-sectional shape in which an annular recess 16 is formed on the inner surface, and a protuberance 10 having an annular, arcuate section is formed around the upper part of the main ring body 17.

Since the main ring body 17 is equipped with the annular recess 16 and the protuberance 10 having an annular, arcuate section, the flexibility of the main ring body 17 as a whole increases for appropriate corresponding O-ring deformation during tightening of cap 13 and so that the hermetic seal between the cap and the filler neck can be improved further.

In all the above embodiments, the lip 9 on the main ring body has the contact surface 7 which has an angle of inclination of 30° so as to correspond to and be substantially, i.e., considerably, smaller than the angle of 45° ($\theta_3$) of the inclined upper surface 12 of the filler neck, but the angle of inclination $\theta_1$ of the contact surface 7 of the lip 9 may be of course selected in various ways corresponding to the angle of inclination $\theta_3$ of the inclined upper surface 12 of the filler neck 11. If the angle $\theta_3$ of the inclined upper surface 12 of the filler neck 11 is 30° or 40°, for example, the angle of inclination $\theta_1$ of the contact surface 7 of the lip 9 is made to be 20° or 30°, a value which is substantially smaller, by from about 10° to about 15°, than $\theta_3$. In short, the angle of inclination $\theta_1$ of the contact surface 7 of the lip 9 is determined in relation to $\theta_3$ so that the contact surface 7 of the lip as a whole comes into contact with the inclined upper surface 12 of the filler neck 11 upon the cap being fully tightening.

The groove angle $\theta_2$ of the upper surface is not particularly limited to 90° but can be selected to be within the approximate range of 70° to 120°, though the resilience of the lip 9 will change to some extent.

The O-ring for a cap in accordance with the present invention can be applied not only to fuel tanks but also to various tanks storing therein other fluids such as water.

EXAMPLE

Figure 1:
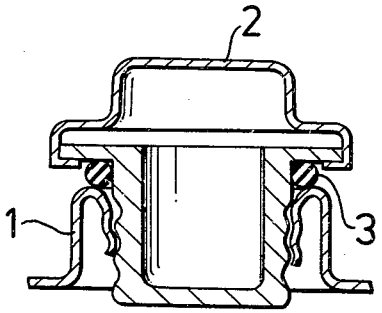
FIG. 1 is a sectional view of a conventional, prior art O-ring disposed between a cap and a filler neck.
Figure 2:
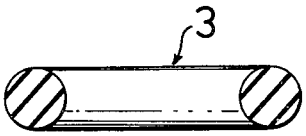
PRIOR ART FIG.2
FIGS. 2 through 4 are each sectional views of conventional O-rings according to the prior art.
Figure 3:
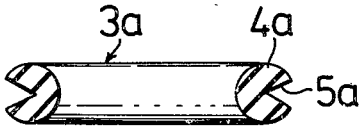
PRIOR ART FIG.3
Figure 4:
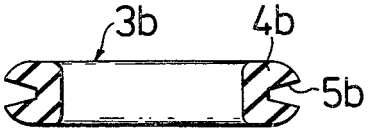
PRIOR ART FIG.4

Experimental Method:

The O-ring of the present invention shown in FIG. 5 (hereinafter referred to as "this invention") and an O-ring having a round cross-section shown in FIG. 2 (hereinafter referred to as "prior art") were placed in conventional resin caps (17251 01A01) and were subjected to durability and one-direction tensile tests for evaluation.

Test Items:

1. Initial performance.
2. Gasoline immersion test: Nisseki silver gasoline RT for 72 hrs.
3. Removal test:
   (1) after 1,000 removals
   (2) immersion in gasoline RT for 72 hrs.
   (3) 1,000 removals
4. Heat resistance test: 80° C. for 4 hrs.

5. Cold resistance test:
   (1) after immersion in Nisseki silver gasoline RT for 72 hrs.
   (2) Held at −30° C. for 30 mins.
6. $O_3$ composite test:
   (1) immersion in "High alum" 2S, at 60° C. for 72 hrs.
   (2) at 80° C. for 24 hrs.
   (3) at 40° C. and 80 PPHM for 72 hrs.
7. Vibration test:
   (1) 3G at 30 cps.
8. Extended gasoline immersion test: Nisseki silver gasoline RT for 10, 20 and 30 days.
9. Tensile test (one-direction tensile test).
10. Return leakage test.

Results of Test:

1. The sealing performance at 0.005 kg/cm$^2$ was found satisfactory for both this invention and the prior art.
2. At pressures higher than 0.7 kg/cm$^2$, both this invention and the prior art satisfied the rated value and were found satisfactory. As a result of a comparison of the performance initially and after the durability test, this invention was found to have an improved quality of about 0.3 kg/cm$^2$ in comparison with the prior art.
3. No significant difference was found between this invention and the prior art in regard to torque. Hence, both were found to be satisfactory.
4. As a result of the one-direction tensile test, this invention, which has a higher initial performance, exhibited a higher durability performance. Hence, this invention was judged to be superior.
5. This invention with its higher resilience was found to have a return leakage angle about 4 times that of the prior art. Hence, this invention exhibited an improved performance.

Observations:

This invention was judged to have an improved cold resistance and a higher sealability during a collision than the prior art, and to be sufficiently comparable to the prior art in other respects. Hence, the quality thereof was found to be improved assumedly by the resilience of the lip around the outer circumference.

TABLE I (Pressure resistance kg/cm$^2$)

| Test item | Initial performance | Gasoline immersion | | Removal | | Heat resistance | | Cold resistance | |
|---|---|---|---|---|---|---|---|---|---|
| Number of samples | 30 | 5 | | 5 | | 5 | | 5 | |
| Rated value | 0.7 kg/cm$^2$ × 305 | | | | | | | | |
| This invention | 3.1–3.7 kg/cm$^2$ (average 3.5 kg/cm$^2$) | 3.3–3.4 (average 3.35) | 1.9–3.4 (average 2.8) | 3.1–3.4 (average 3.3) | 3.1–3.35 (average 3.2) | 3.4–3.7 (average 3.5) | 3.4–3.7 (average 3.6) | 3.2–3.4 (average 3.3) | 1.0–1.3 (average 1.15) |
| Prior art | 3.15–3.9 kg/cm$^2$ (average | 3.7–3.9 (average 3.8) | 1.9–3.1 (average 2.3) | 3.15–3.8 (average 3.5) | 2.45–2.6 (average 2.5) | 3.4–3.7 (average 3.55) | 3.4–3.5 (average 3.45) | 3.5–3.7 (average 3.6) | 0.95–1.2 (average 1.05) |
| Conditions | | Initially | After testing | Initially | After testing | Initially | After testing | Initially | After testing |

| Test item | $O_3$ composite test | | Vibration | Extended gasoline immersion | | | |
|---|---|---|---|---|---|---|---|
| Number of samples | 5 | | 5 | 5 | | | |
| Rated value | | | | | | | |
| This invention | 3.3–3.4 (average 3.3) | 1.45–1.85 (average 1.7) | 2.0 kg/cm$^2$ Measurements at predetermined pressure O.K. | 3.3–3.6 (average 3.4) | 2.1–3.2 (average 2.45) | 1.95–2.4 (average 2.2) | 1.5–1.95 (average 1.65) |
| Prior art | 3.6–3.8 (average 3.7) | 1.4–1.5 (average 1.4) | 2.0 kg/cm$^2$ Measurements at predetermined pressure O.K. | 3.6–3.8 (average 3.7) | 2.1–2.4 (average 2.25) | 1.7–2.0 (average 1.9) | 1.45–1.6 (average 1.55) |
| Conditions | Initially | After testing | | Initially | 10 days | 20 days | 30 days |

TABLE II (torque kgm)

| Test item | Initial performance | Gasoline immersion | | Removal | | Heat resistance | |
|---|---|---|---|---|---|---|---|
| Number of samples | 30 | 5 | | 5 | | 5 | |
| Rated value | 0.1–0.3 kgm | — | | 0.1–0.3 kgm | | above 0.05 kgm | |
| This invention | 0.15–0.2 (average 0.175) | 0.16–0.18 (average 0.17) | 0.16–0.19 (average 0.17) | 0.17–0.18 (average 0.175) | 0.16–0.17 (average 0.165) | 0.16–0.18 (average 0.17) | 0.13–0.16 (average 0.15) |
| Prior art | 0.16–0.2 (average 0.175) | 0.17–0.20 (average 0.18) | 0.16–0.19 (average 0.17) | 0.17–0.18 (average 0.175) | 0.17–0.18 (average 0.175) | 0.16–0.18 (average 0.17) | 0.14–0.16 (average 0.15) |
| Conditions | | Initially | After testing | Initially | After testing | Initially | After testing |

TABLE II-continued (torque kgm)

| Test item | Cold resistance | | $O_3$ composite test | | Extended gasoline immersion | | | |
|---|---|---|---|---|---|---|---|---|
| Number of samples | 5 | | 5 | | 5 | | | |
| Rated value | below 0.4 kgm | | — | | — | | | |
| This invention | 0.15–0.18 (average 0.17) | 0.17–0.18 (average 0.18) | 0.18–0.20 (average 0.19) | 0.14–0.18 (average 0.155) | 0.18–0.20 (average 0.19) | 0.18–0.19 (average 0.185) | 0.18–0.19 (average 0.18) | 0.17–0.19 (average 0.18) |
| Prior art | 0.16–0.18 (average 0.17) | 0.18–0.22 (average 0.20) | 0.17–0.18 (average 0.175) | 0.15–0.16 (average 0.155) | 0.18–0.20 (average 0.19) | 0.18–0.20 (average 0.19) | 0.17–0.19 (average 0.18) | 0.16–0.19 (average 0.18) |
| Conditions | Initially | After testing | Initially | After testing | Initially | 10 days | 20 days | 30 days |

TABLE III (1) Gasoline immersion test Condition: Nisseki silver RT for 72 hrs.

| | Initial performance | | | After testing | | |
|---|---|---|---|---|---|---|
| | Torque (kgm) | 0.005 kg/cm² pressure resistance | Pressure resistance (kg/cm²) | Torque (kgm) | 0.005 kg/cm² pressure resistance | Pressure resistance (kg/cm²) |
| Round O-ring 38150 17135 | | | | | | |
| 1 | 0.20 | OK | 3.90 | 0.18 | OK | 3.10 |
| 2 | 0.19 | OK | 3.70 | 0.17 | OK | 2.20 |
| 3 | 0.17 | OK | 3.70 | 0.17 | OK | 1.90 |
| 4 | 0.18 | OK | 3.70 | 0.18 | OK | 2.40 |
| 5 | 0.17 | OK | 3.70 | 0.16 | OK | 1.90 |
| $\bar{x}$ | 0.18 | OK | 3.74 | 0.17 | OK | 2.30 |
| Deformed O-ring 38155 B17135 | | | | | | |
| 1 | 0.18 | OK | 3.40 | 0.17 | OK | 2.30 |
| 2 | 0.17 | OK | 3.30 | 0.16 | OK | 1.90 |
| 3 | 0.16 | OK | 3.40 | 0.16 | OK | 3.20 |
| 4 | 0.18 | OK | 3.30 | 0.18 | OK | 3.20 |
| 5 | 0.16 | OK | 3.40 | 0.17 | OK | 3.40 |
| $\bar{x}$ | 0.17 | OK | 3.36 | 0.17 | OK | 2.80 |

TABLE IV (2) Removal test

Conditions: 1. after 1,000 removals
2. gasoline immersion RT for 72 hrs.
3. 1,000 removals

| | Initial performance | | | After testing | | |
|---|---|---|---|---|---|---|
| | Torque (kgm) | 0.005 kg/cm² pressure resistance | Pressure resistance (kg/cm²) | Torque (kgm) | 0.005 kg/cm² pressure resistance | Pressure resistance (kg/cm²) |
| Round O-ring 38150 17135 | | | | | | |
| 6 | 0.18 | OK | 3.30 | 0.17 | OK | 2.45 |
| 7 | 0.18 | OK | 3.70 | 0.18 | OK | 2.50 |
| 8 | 0.17 | OK | 3.80 | 0.18 | OK | 2.60 |
| 9 | 0.18 | OK | 3.15 | 0.17 | OK | 2.45 |
| 10 | 0.17 | OK | 3.50 | 0.17 | OK | 2.50 |
| $\bar{x}$ | 0.18 | OK | 3.51 | 0.17 | OK | 2.50 |
| Deformed O-ring 38155 B17135 | | | | | | |
| 6 | 0.17 | OK | 3.40 | 0.16 | OK | 3.35 |
| 7 | 0.18 | OK | 3.30 | 0.16 | OK | 3.10 |
| 8 | 0.17 | OK | 3.10 | 0.17 | OK | 3.20 |
| 9 | 0.18 | OK | 3.30 | 0.16 | OK | 3.30 |
| 10 | 0.17 | OK | 3.40 | 0.16 | OK | 3.15 |
| $\bar{x}$ | 0.17 | OK | 3.30 | 0.16 | OK | 3.22 |

TABLE V (3) Heat resistance test Condition: held at 80° C. for 4 hrs.

| | Initial performance | | | After testing | | |
|---|---|---|---|---|---|---|
| | Torque (kgm) | 0.005 kg/cm² pressure resistance | Pressure resistance (kg/cm²) | Torque (kgm) | 0.005 kg/cm² pressure resistance | Pressure resistance (kg/cm²) |
| Round O-ring 38150 17135 | | | | | | |
| 11 | 0.19 | OK | 3.70 | 0.16 | OK | 3.4 |
| 12 | 0.16 | OK | 3.60 | 0.15 | OK | 3.5 |
| 13 | 0.17 | OK | 3.70 | 0.14 | OK | 3.4 |
| 14 | 0.18 | OK | 3.40 | 0.15 | OK | 3.4 |

TABLE V-continued

| (3) Heat resistance test Condition: held at 80° C. for 4 hrs. | | | | | | |
|---|---|---|---|---|---|---|
| 15 | 0.17 | OK | 3.50 | 0.15 | OK | 3.5 |
| $\bar{x}$ | 0.17 | OK | 3.60 | 0.15 | OK | 3.4 |
| Deformed O-ring 38155 B17135 | | | | | | |
| 11 | 0.19 | OK | 3.60 | 0.14 | OK | 3.7 |
| 12 | 0.19 | OK | 3.70 | 0.16 | OK | 3.6 |
| 13 | 0.17 | OK | 3.40 | 0.16 | OK | 3.4 |
| 14 | 0.16 | OK | 3.40 | 0.14 | OK | 3.5 |
| 15 | 0.16 | OK | 3.50 | 0.13 | OK | 3.7 |
| $\bar{x}$ | 0.17 | OK | 3.50 | 0.15 | OK | 3.6 |

TABLE VI (4) Cold resistance

Conditions: 1. after immersion in Nisseki silver RT for 72 hrs.
2. held at −30° C. for 30 min.

| | Initial performance | | | After testing | | |
|---|---|---|---|---|---|---|
| | Torque (kgm) | 0.005 kg/cm$^2$ pressure resistance | Pressure resistance (kg/cm$^2$) | Torque (kgm) | 0.005 kg/cm$^2$ pressure resistance | Pressure resistance (kg/cm$^2$) |
| Round O-ring 38150 17135 | | | | | | |
| 1 | 0.18 | OK | 3.50 | 0.19 | OK | 1.05 |
| 2 | 0.17 | OK | 3.60 | 0.20 | OK | 1.20 |
| 3 | 0.18 | OK | 3.60 | 0.19 | OK | 1.15 |
| 4 | 0.17 | OK | 3.50 | 0.22 | OK | 1.00 |
| 5 | 0.16 | OK | 3.70 | 0.18 | OK | 0.95 |
| $\bar{x}$ | 0.17 | OK | 3.60 | 0.20 | OK | 1.07 |
| Deformed O-ring 38155 B17135 | | | | | | |
| 1 | 0.17 | OK | 3.40 | 0.18 | OK | 1.25 |
| 2 | 0.16 | OK | 3.30 | 0.18 | OK | 1.30 |
| 3 | 0.15 | OK | 3.40 | 0.17 | OK | 1.15 |
| 4 | 0.18 | OK | 3.20 | 0.18 | OK | 1.10 |
| 5 | 0.17 | OK | 3.30 | 0.19 | OK | 1.00 |
| $\bar{x}$ | 0.17 | OK | 3.30 | 0.18 | OK | 1.16 |

TABLE VII (5) $O_3$ composite test

Conditions: 1. immersed in "High alum" 2S at 60° C. for 72 hrs.
2. at 80° C. for 24 hrs.
3. at 40° C. and 80 ppHM for 72 hrs.

| | Initial performance | | | After testing | | |
|---|---|---|---|---|---|---|
| | Torque (kgm) | 0.005 kg/cm$^2$ pressure resistance | Pressure resistance (kg/cm$^2$) | Torque (kgm) | 0.005 kg/cm$^2$ pressure resistance | Pressure resistance (kg/cm$^2$) |
| Round O-ring 38150 17135 | | | | | | |
| 16 | 0.17 | OK | 3.70 | 0.15 | OK | 1.40 |
| 17 | 0.18 | OK | 3.80 | 0.16 | OK | 1.50 |
| 18 | 0.17 | OK | 3.70 | 0.15 | OK | 1.40 |
| 19 | 0.18 | OK | 3.60 | 0.15 | OK | 1.50 |
| 20 | 0.17 | OK | 3.70 | 0.16 | OK | 1.40 |
| $\bar{x}$ | 0.17 | OK | 3.70 | 0.15 | OK | 1.42 |
| Deformed O-ring 38155 B17135 | | | | | | |
| 16 | 0.20 | OK | 3.40 | 0.14 | OK | 1.85 |
| 17 | 0.18 | OK | 3.30 | 0.15 | OK | 1.60 |
| 18 | 0.20 | OK | 3.40 | 0.14 | OK | 1.80 |
| 19 | 0.18 | OK | 3.30 | 0.16 | OK | 1.45 |
| 20 | 0.20 | OK | 3.30 | 0.18 | OK | 1.80 |
| $\bar{x}$ | 0.19 | OK | 3.30 | 0.15 | OK | 1.72 |

TABLE VIII (6) Vibration test Condition: 3G at 30 cps

| | Initial performance | | | After testing | | |
|---|---|---|---|---|---|---|
| | Torque (kgm) | 0.005 kg/cm$^2$ pressure resistance | Pressure resistance (kg/cm$^2$) | Torque (kgm) | 0.005 kg/cm$^2$ pressure resistance | Pressure resistance (kg/cm$^2$) |
| Round O-ring 38150 17135 | | | | | | |
| 21 | — | OK | 3.70 | — | OK | 2.0 OK |
| 22 | — | OK | 3.80 | — | OK | 2.0 OK |
| 23 | — | OK | 3.70 | — | OK | 2.0 OK |
| 24 | — | OK | 3.80 | — | OK | 2.0 OK |

TABLE VIII-continued

| | | | | | | |
|---|---|---|---|---|---|---|
| (6) Vibration test Condition: 3G at 30 cps | | | | | | |
| 25 | — | OK | 3.60 | — | OK | 2.0 OK |
| $\bar{x}$ | — | OK | 3.72 | — | OK | OK |
| Deformed O-ring 38155 B17135 | | | | | | |
| 21 | — | OK | 3.40 | — | OK | 2.0 OK |
| 22 | — | OK | 3.50 | — | OK | 2.0 OK |
| 23 | — | OK | 3.40 | — | OK | 2.0 OK |
| 24 | — | OK | 3.30 | — | OK | 2.0 OK |
| 25 | — | OK | 3.30 | — | OK | 2.0 OK |
| $\bar{x}$ | — | OK | 3.32 | — | OK | OK |

TABLE IX

| (7) Extended gasoline immersion test Condition: Nisseki silver RT for 10, 20 & 30 days | | | | | | |
|---|---|---|---|---|---|---|
| | Initial performance | | | After 10 days | | |
| | Torque (kgm) | Pressure resistance 0.005 kg/cm$^2$ | Pressure resistance (kg/cm$^2$) | Torque (kgm) | Pressure resistance 0.005 kg/cm$^2$ | Pressure resistance (kg/cm$^2$) |
| Round O-ring 38150 17135 | | | | | | |
| 26 | 0.18 | OK | 3.70 | 0.18 | OK | 2.20 |
| 27 | 0.20 | OK | 3.70 | 0.20 | OK | 2.10 |
| 28 | 0.20 | OK | 3.70 | 0.20 | OK | 2.30 |
| 29 | 0.18 | OK | 3.80 | 0.18 | OK | 2.40 |
| 30 | 0.18 | OK | 3.60 | 0.18 | OK | 2.20 |
| $\bar{x}$ | 0.19 | OK | 3.70 | 0.19 | OK | 2.25 |
| Deformed O-ring 38155 B17135 | | | | | | |
| 26 | 0.18 | OK | 3.30 | 0.18 | OK | 2.10 |
| 27 | 0.19 | OK | 3.40 | 0.18 | OK | 2.10 |
| 28 | 0.20 | OK | 3.30 | 0.19 | OK | 2.20 |
| 29 | 0.18 | OK | 3.40 | 0.18 | OK | 3.20 |
| 30 | 0.19 | OK | 3.60 | 0.18 | OK | 2.50 |
| $\bar{x}$ | 0.19 | OK | 3.40 | 0.18 | OK | 2.42 |
| | After 22 days | | | After 30 days | | |
| | Torque (kgm) | Pressure resistance 0.005 kg/cm$^2$ | Pressure resistance (kg/cm$^2$) | Torque (kgm) | Pressure resistance 0.005 kg/cm$^2$ | Pressure resistance (kg/cm$^2$) |
| Round O-ring 38150 17135 | | | | | | |
| 26 | 0.18 | OK | 2.00 | 0.16 | OK | 1.50 |
| 27 | 0.17 | OK | 2.00 | 0.18 | OK | 1.60 |
| 28 | 0.18 | OK | 1.85 | 0.18 | OK | 1.50 |
| 29 | 0.19 | OK | 1.70 | 0.18 | OK | 1.45 |
| 30 | 0.18 | OK | 1.85 | 0.19 | OK | 1.60 |
| $\bar{x}$ | 0.18 | OK | 1.88 | 0.18 | OK | 1.58 |
| Deformed O-ring 38155 B17135 | | | | | | |
| 26 | 0.18 | OK | 2.00 | 0.17 | OK | 1.70 |
| 27 | 0.19 | OK | 1.95 | 0.18 | OK | 1.80 |
| 28 | 0.19 | OK | 2.20 | 0.19 | OK | 1.50 |
| 29 | 0.18 | OK | 2.40 | 0.18 | OK | 1.80 |
| 30 | 0.18 | OK | 2.20 | 0.19 | OK | 1.95 |
| $\bar{x}$ | 0.18 | OK | 2.20 | 0.18 | OK | 1.65 |

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. For use in providing a seal between a filler neck and a cap, an O-ring characterized by a single main body having an integrally formed annular lip projecting outwardly from the main body, said lip having an inclined lower surface for contacting a corresponding inclined upper surface of said filler neck, said lip lower surface defining an angle of inclination $\theta_1$ with respect to the horizontal principal extent of the O-ring body, said filler neck upper surface defining an angle of inclination $\theta_3$ with respect to horizontal, $\theta_1$ being substantially less than $\theta_3$, said annular lip being deformable upon tightening of said cap to bring said lip lower surface into hermetically sealing contact with said filler neck upper surface.

2. An O-ring according to claim 1 and further characterized by $\theta_1$, being less than $\theta_3$ by an amount sufficient for causing said lip lower surface to come wholly into contact with said filler neck inclined surface upon said cap being fully tightened.

3. An O-ring according to claim 2 and further characterized by $\theta_1$ being less than $\theta_3$ by from about 10° to about 15°.

4. An O-ring according to claim 3, $\theta_1$ being approximately 30° and $\theta_3$ being approximately 45°.

5. An O-ring according to claim 1 and further characterized by said annular lip having an upper surface defining an angle $\theta_2$ with said main ring body of approximately from 70° to 120°.

6. An O-ring according to claim 1 and further characterized by said main body defining an internal surface for surroundingly engaging a corresponding portion of said cap and an upper surface extending beneath a corresponding overlying portion of said cap and said main body including a protuberance extending upwardly from its upper surface for contacting said cap overlying portion.

7. An O-ring according to claim 6 and further characterized by said protuberance being of arcuate cross-section which is compressed upon tightening of said cap.

8. An O-ring according to claim 6 and further characterized by said protuberance being of rectangular cross-section in a region for contacting said cap overlying portion.

9. An O-ring according to claim 6 and further characterized by said internal surface being provided with an annular recess of arcuate section.

10. An O-ring according to claim 1 and further characterized by said angle of inclination $\theta_1$ increasing to and becoming the same as angle of inclination $\theta_3$ upon tightening of said cap.

* * * * *